US006773224B2

(12) United States Patent
Itou et al.

(10) Patent No.: US 6,773,224 B2
(45) Date of Patent: Aug. 10, 2004

(54) CONTROL METHOD OF PLURAL COMPRESSORS AND COMPRESSOR SYSTEM

(75) Inventors: Toshio Itou, Tsuchiura (JP); Kazuo Takeda, Chiyoda (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/101,312

(22) Filed: Mar. 20, 2002

(65) Prior Publication Data

US 2003/0053906 A1 Mar. 20, 2003

(30) Foreign Application Priority Data

Sep. 18, 2001 (JP) ..... 2001-282573

(51) Int. Cl.[7] ..... F01D 17/04; F01D 17/08

(52) U.S. Cl. ..... 415/1; 415/29

(58) Field of Search ..... 415/1, 27, 29, 415/914, 160, 161

(56) References Cited

U.S. PATENT DOCUMENTS 4,580,947 A * 4/1986 Shibata et al. ..... 417/8
4,770,602 A * 9/1988 Miura et al. ..... 415/29
5,343,384 A * 8/1994 Fisher et al. ..... 417/8
5,347,467 A * 9/1994 Staroselsky et al. ..... 415/1

FOREIGN PATENT DOCUMENTS

JP 2000-120583 4/2000

* cited by examiner

*Primary Examiner*—Edward K. Look
*Assistant Examiner*—Igor Kershteyn
(74) *Attorney, Agent, or Firm*—Crowell & Moring LLP

(57) ABSTRACT

In a compressor system, in which plural numbers of compressors are connected in parallel with, wherein flow rate of all the compressor main bodies driven under load operating condition is decreased down by closing each of the inlet guide vanes thereof, when a load of the compressor goes down, and then the compressor rushing into surge at the earliest is brought into unload operating condition. Thereafter, the flow rates of the compressors other than that brought into the un-load operating conditions are increased up, thereby conducting the operation of the compressor depending upon the load.

9 Claims, 3 Drawing Sheets

CONTROL METHOD OF PLURAL COMPRESSORS AND COMPRESSOR SYSTEM

BACKGROUND OF THE INVENTION

The present invention relates to a control method for plural numbers of compressors, being connected in parallel with each other, and a compressor system according thereto.

An example of such the compressor system, in which plural numbers of compressors are connected in parallel, is described in Japanese Patent Laying-Open No. 2000-12583, for example. In this publication, the requested flow rate is divided into plural numbers of flow adjustment regions, so that the sum of the maximum values of supply flows of the compressors operating comes to be equal to or greater than that requested flow, and also the number of the compressors operating comes to the minimum. And, also with this, for each of the flow adjusting regions is preset or provided a flow control pattern, which indicates a combination of those operating compressors, as well as, a control condition of each of the operating compressors, thereby the each compressor is controlled in accordance with that preset pattern. In the case including the compressor(s) therein, on which can be obtained only ON/OFF control, the compressor(s), on which can be obtained a constant gas pressure, as well as, the ON/OFF control, is determined to be a machine(s) for use in flow rate adjusting. In a region(s) neighboring to the region in the flow rte, which is preset to this compressor, the compressor(s), on which can be obtained only ON/OFF control, is/are used as the machine(s) for use in flow rate adjusting, with priority. With this, it is possible to lessen the waste of pressurized gas during unload operation, as well as, to enable to protect the plural numbers of compressors from rushing into a surge waiting condition simultaneously, as far as possible.

In the control method for the plural numbers of compressors described in the publication mentioned above, the characteristic on flow rate is determined for each of the plural numbers of compressors, and each of those compressors is controlled with using the preset flow rate control pattern on the basis of the characteristic thereof. However, due to interior conditions of the compressor, such as, unclearness or dust inside the compressor machine, etc., and/or external conditions, such as, fluctuations in temperature and pressure on gas flowing into the compressor for each season, etc., there occurs occasion that the actual operation point of each compressor differs from that expected. In such case, trying to control the compressor compulsively by using the predetermined control patter causes the situation that the operation point reaches to the surge limit earlier that expected, and/or that the compressor (s) is brought into an unloaded operation very much before that surge limit. As a result of this, there are risks of bringing about drawbacks that each compressor consume useless motive power, and/or that the compressor operates unstably due to sudden rushing of the surge.

BRIEF SUMMARY OF THE INVENTION

An object, according to the present invention, by taking the drawbacks of such the conventional arts as mentioned above into the consideration thereof, is to provide a compressor system having plural numbers of compressors, wherein a partial load control is made easy by means of a simple control system. Other object, according to the present invention, is to provide a compressor system having plural numbers of compressors, wherein power consumption can be reduced. Further other object, according to the present invention, is to operate the plural numbers of compressors effectively under the situation where the operating conditions fluctuate. And the present invention is made for accomplishing at least one of those objects mentioned above.

According to the present invention, for accomplishing the above object mentioned above, there is provided a control method for plural numbers of compressors, comprising the following steps of: decreasing down flow rates of all the compressors which are driven under load operating condition, when a load of plural numbers of the compressors goes down; bringing the compressor, which rushes into surge at the earliest, into an un-load operating condition; and increasing up the load of the compressors other than that brought into the un-load operating condition, thereby enabling an operation depending upon the load.

Also, according to the present invention, in the control method for plural numbers of compressors defined in the above, preferably, wherein said plural numbers of the compressors are turbo compressors, and said method further comprises the following steps of: obtaining surge limit of at least one of the compressors in advance; and memorizing the surge limit into memory means, wherein the flow rate is decreased down quickly until a point where the flow rate is larger than the surge limit memorized in said memory means by a predetermined amount, when decreasing down the flow rate generated by the compressor as the load comes down, and thereafter is changed more slowly than a period before, until a time of rushing into surge of generating surge.

Further, according to the present invention, in the control method for plural numbers of compressors defined in the above, wherein the surge limit data memorized in said memory means may be an opening angle of inlet guide vanes, and the surge limit data memorized in said memory means may be renewed by the opening angle of the inlet guide vanes of when rushing into the surge; wherein in a case of the compressor having the surge limit data obtained in advance among the plural numbers of the compressors, the data may be memorized in said memory means, while in a case of the compressor having no surge limit data, the data of the compressor having the surge limit data therein is applied to in place thereof; wherein the compressors are started in an order of rushing into the surges and brought into the un-load operating condition, when all the compressors are stopped and then they are started again; wherein the compressors under the un-load operating conditions are brought into the load operating conditions in an order of rushing into the surge earlier, when turning them back, if the compressors under the un-load operating conditions are plural in number thereof while the load increases up; and wherein the flow rate is reduced down so as to rush into the surge, and it is turned back to that at the time just before rushing into the surge, after once rushing into the surge, while a blow-off valve is opened, when the compressor under load operating condition is one (1) and the load goes down, thereby enabling control depending upon the load.

Also, according to the present invention, for accomplishing the object mentioned above, there is provided a control method for plural numbers of compressors, comprising the following steps of: observing power consumed in each compressor by decreasing flow rates of all the compressors driven under load operating condition down to a surge limit memorized in memory means in advance, when a load of the plural numbers of the compressors goes down; bringing the compressor showing the largest power consumption into an unload operating condition; and increasing up the flow rates of the compressors other than that brought into the unload operating condition, whereby enabling an operation depending upon the load.

Further, according to the present invention, there is provided a compressor system having plural numbers of compressors connected in parallel, comprising: surge detection means provided at discharge side of each of the plural numbers of compressors; and a controller means for controlling each of said plural numbers of compressors, so that a load for each of all the compressors is reduced down when a load of said compressor system goes down and the compressor rushing into surge at first is brought into an unloaded operating condition, while increasing up the loads of the other compressors.

And, also in the compressor system as defined in the above, preferably, wherein each of said plural numbers of compressors is a turbo compressor having an inlet guide vanes at a suction side thereof, and said controller means gives an instruction of rotation angle to the inlet guide vanes depending upon change on the load of the each compressor; further comprising a discharge-pressure detection means of the compressor system, provided in a downstream side from a junction position of said plural numbers of compressors connected in parallel, wherein said controller means gives an instruction of rotation angle to each of the inlet guide vanes, so that the discharge-pressure comes to be a predetermined pressure; and wherein said controller means has memory means for memorizing surge limit therein.

BRIEF DESCRIPTION OF THE SEVERAL VIEWS OF THE DRAWING

Those and other features, objects and advantages of the present invention will become more apparent from the following description when taken in conjunction with the accompanying drawings wherein.

DETAILED DESCRIPTION OF THE INVENTION

Figure 1:
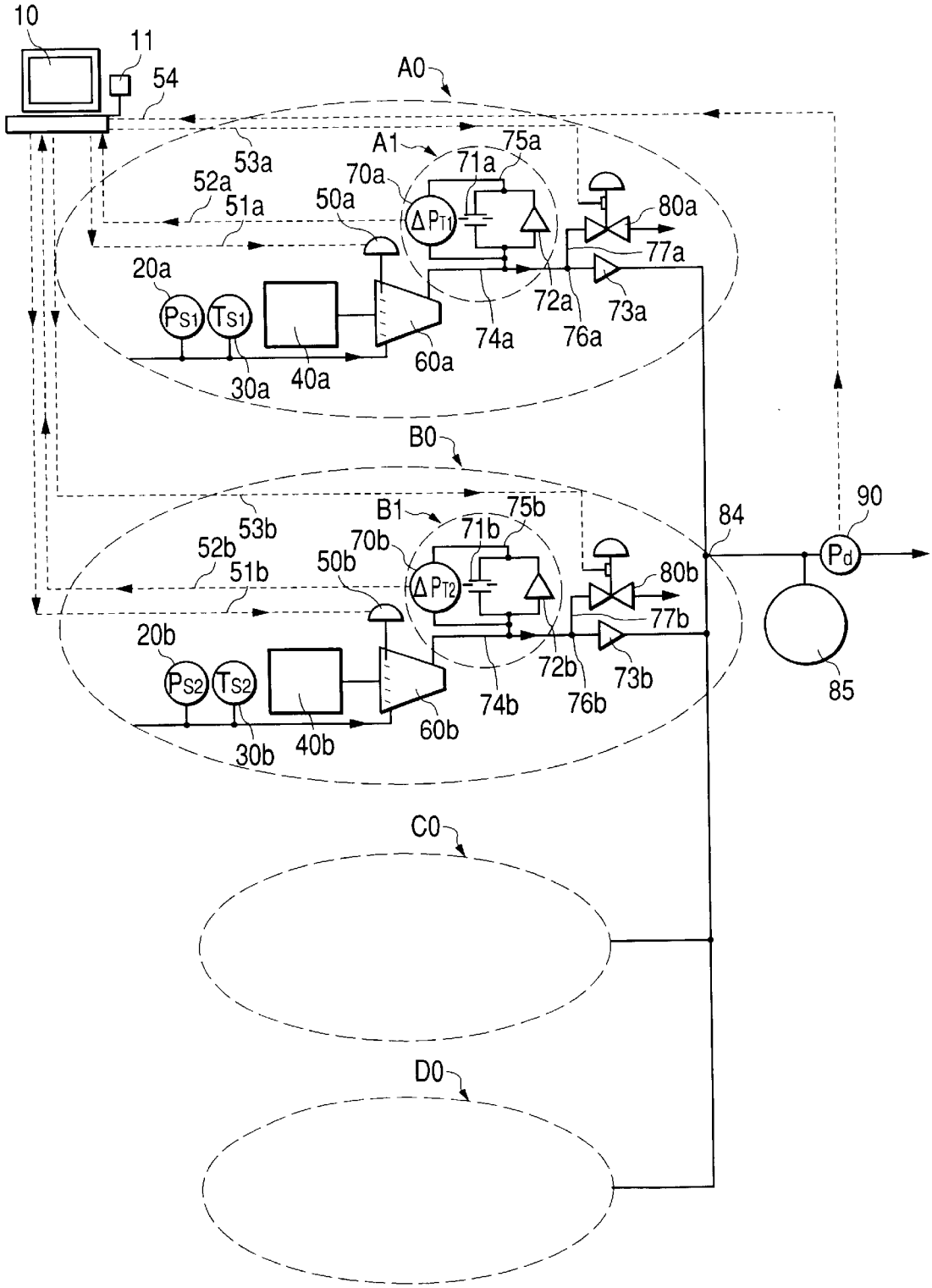
FIG. 1 is a block diagram of compressor system according to an embodiment of the present invention FIGS. 2(*a*) to 2(*e*) are graphs for explaining a partial load control of the compressor system, according to the present invention.
Figure 2A:
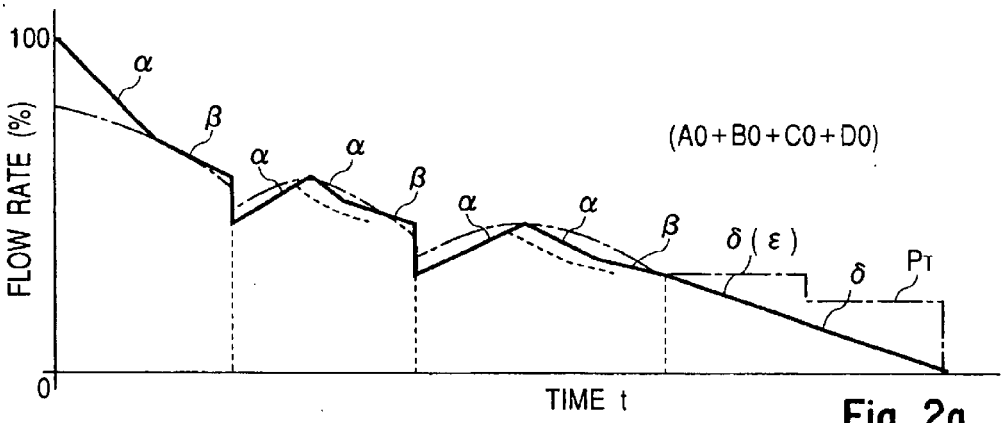
Figure 2B:
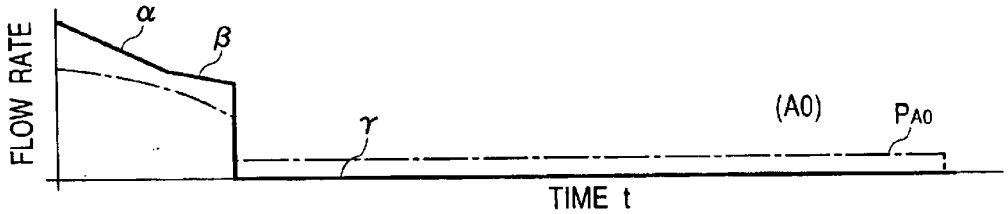
Figure 2C:
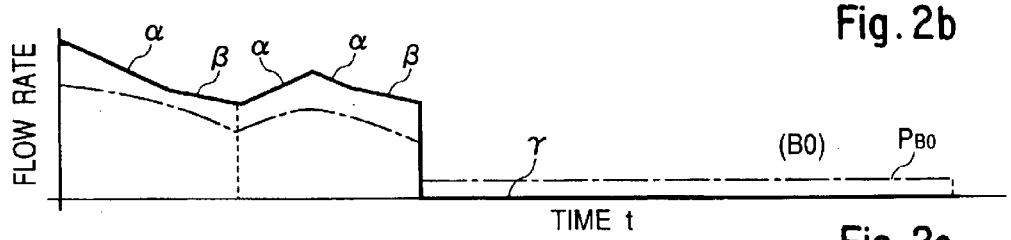
Figure 2D:
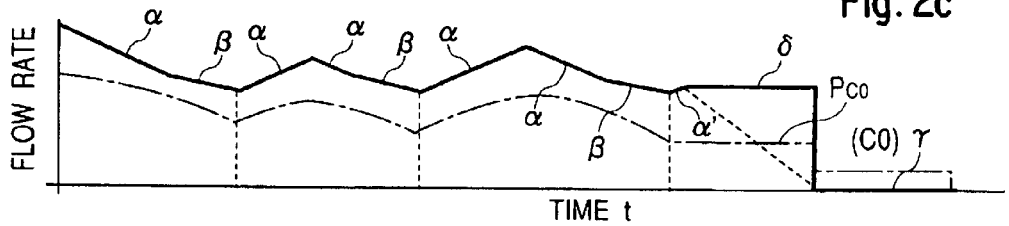
Figure 2E:
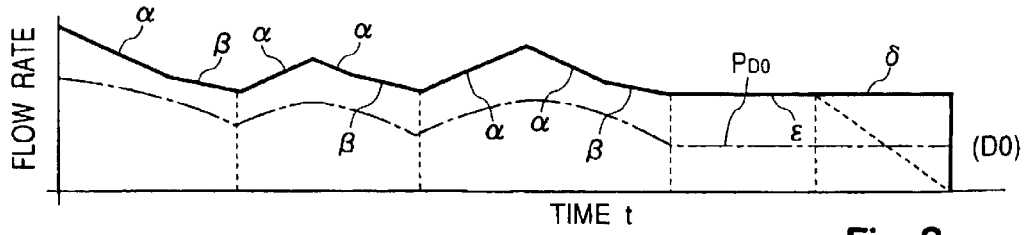
Figure 3:
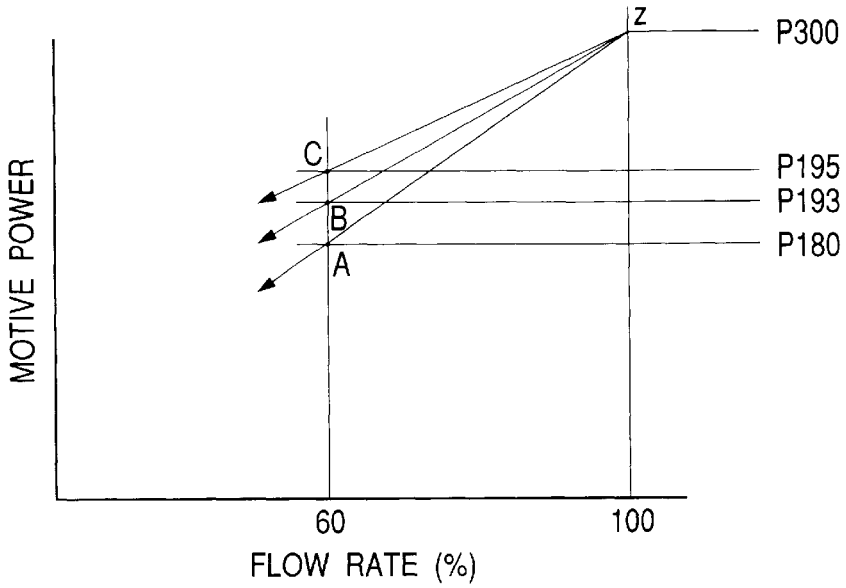
FIG. 3 is a graph for explaining motive power, which is consumed in the compressor system.
Figure 4:
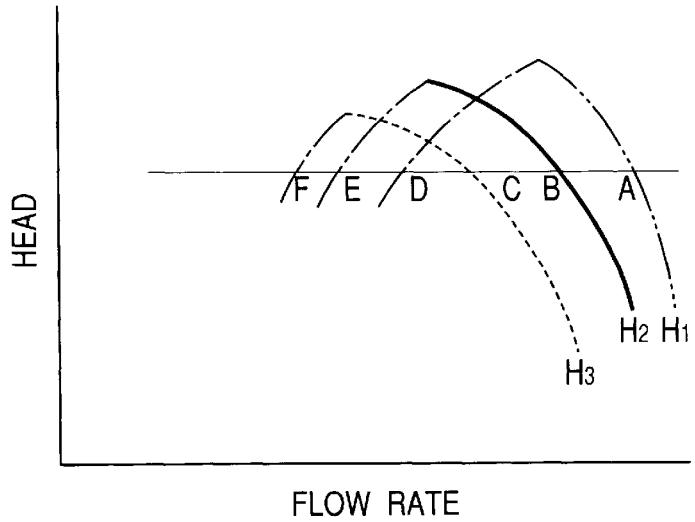
FIG. 4 is a graph for explaining performances of the compressor, which is provided in the compressor system.

Hereinafter, preferred embodiment of a control method of plural numbers of compressors, according to the present invention will be fully explained by referring to the attached drawings. FIG. 1 shows the block diagram of a compressor system, in which plural numbers of compressors are connected in parallel with. FIGS. 2(*a*) to 2(*e*) are graphs for showing power consumption when four (4) compressors are connected in parallel. Also, FIG. 3 is a graph for showing the difference between an estimated value and an actually measured value on the graph of performances of the compressor. FIG. 4 is a graph for showing the difference in the performances of the compressor depending upon the suction condition of a gas, which is sucked into the compressor.

In the compressor system, according to the embodiment of the present invention, as shown in FIG. 1, four (4) sets of compressors A0, B0, C0 and D0, are connected in parallel with. A compressor controller 10 controls those compressors A0, B0, C0 and D0, which are connected in parallel with, for each. Each of the compressors A0, B0, C0 and D0 is a turbo compressor of a small capacity, and they are same in the type and the capacity to one another. Since every compressor has the same structure, hereinafter, explanation will be given only the compressor A0, as a representative one thereof. The compressor A0 has a main body 60*a* of the compressor. At a suction side of the compressor main body 60*a* is provided an inlet guide vanes (IGV) 50*a*, thereby to adjust an amount of operating gas sucked into. In a further upper stream of the inlet guide vane 50*a* are provided a pressure sensor 20*a* for detecting suction pressure Ps1 and a temperature sensor 30*a* for detecting suction temperature Ts1. Further, into the inlet guide vane it is inputted an opening instruction signal through a signal cable 51*a* from the controller 10, which will be described in more details thereof later.

For the purpose of rotating the compressor main body 60*a*, a driving machine 40*a* is connected onto a rotation shaft of the compressor main body 60*a*. At an outlet side of the compressor main body 60*a* is connected a conduit 74*a*, on which is attached a differential pressure gauge A1. This differential pressure gauge A1 comprises an orifice 71*a* for taking out the pressure change of operation gas flowing within the conduit 74*a*, a check valve 72*a* provided in parallel with the orifice 71*a*, and a pressure sensor 70*a* connected in series with the orifice 71*a* and the check valve 72*a* through a conduit 75*a*. With this, the pressure sensor 70*a* is able to measure the pressures before and after the orifice 71*a*.

A discharge pressure signal of the compressor main body 60*a*, which is detected by the differential pressure gauge A1, is inputted into the controller 10 through a signal line 52*a*. A branch portion 76*a* is formed in the downstream of the differential pressure gauge A1, and a blow-off valve 80*a* is attached on a conduit 77*a* divided. To this blow-off valve 80*a* is transmitted an instruction signal of instructing blow-off into the air or into other gas storage means not shown in the figure, through a signal line 53*a*. On a while, a check valve 73*a* is attached to the conduit 74*a*. Compressed gas discharged from each of the compressors A0–D0 is collected or combined with in the downstream side of the check valve 73*a*, thereby to be stored in a receiver tank, as a compressed gas therein. The discharge pressure Pd of the compressor system is detected by means of a pressure gauge 90, which lies between the discharge conduits. This pressure signal detected is transmitted to the controller 10 through a signal line 54.

The structures of the compressor A0 is as was mentioned above. Since the structures of those compressors B0, C0 and D0 are also the same to the above, therefore, the detailed explanation thereof will be omitted herein. Next, explanation will be given on the controller 10. This controller 10 comprises a memory means 11 for memorizing therein surge limit data for each of the compressor main bodies 60*a*–60*d*. To this controller 20 are inputted the discharge pressure information of the respective compressors 60*a*, 60*b* . . . which are detected by the differential pressure gauges A1, B1 . . . , and a signal of the discharge pressure Pd of the compressor system. Though not shown in the figure, to the controller 10 are inputted further information of the temperature sensors 30*a*, 30*b* . . . and of the pressure sensors 20*a*, 20*b* . . . which are provided in the suction sides of the compressor main bodies 60*a*, 60*b* . . . , respectively. On a while, from the controller 10 are issued or generated instructions for rotating the inlet guide vanes 50*a*, 50*b* . . . and for opening/closing the blow-off valve 80*a*, 80*b* . . . .

The operation will be described in more detail on the differential pressure gauge A1 of the present embodiment, being structured in this manner. The pressure of compressed gas, being guided from the conduit 74*a* to the differential pressure gauge A1, passes through the check valve 72*a*, and is transmitted to the pressure sensor 70*a*. When the pressure in the conduit 74*a* goes up, the pressure is transmitted immediately to the pressure sensor 70*a* through the check valve 72*a*. For this reason, there is almost no difference in pressure between the conduit 74*a* and the pressure sensor 70*a*.

On the contrary to this, when the pressure in the conduit 74*a* falls down, the pressure can be transmitted to the conduit 75*a* only from the conduit provided at the side of the orifice 71*a*. As a result of this, the pressure at the side of the conduit 75*a* only falls down gradually from the pressure before it falls down. On a while, the pressure in the conduit 74*a* falls down, quickly, corresponding to the pressure fluctuation of the compressed gas, which is discharged from the compressor main body 60*a*. Accordingly, the differential pressure is generated between the conduit 74*a* and the conduit 75*a*. This differential pressure is detected by the differential pressure gauge 70*a*, and the information thereof is transmitted to the controller.

Next, explanation will be given on the method for controlling the compressor system having plural numbers of compressors therein, as was shown in FIG. 1 mentioned above, by referring to FIG. 2. In this FIG. 2, the upper most graph shows the change in the flow rate with respect to a time, which is discharged from the compressor system, while other fours below it show the flow rates to a time, which are discharged from the compressors A0–D0, respectively. The explanation will be made only on a case when the load is decreased down from a situation where all the four compressors are operating under the loads, respectively, as an example. Herein, it is assumed that a starting point is a situation when the compressor system operates under 100% of the load, in other words, the 100% flaw rate. Further, it is also assumed that the discharge pressure detected by the pressure sensor 90 is set so that the pressure of the gas reached to the end consumer comes to be higher than a requested pressure value.

With decreasing of a consumption of the compressed gas in the amount or volume at the end of demand, when detecting the reduction of the load, the controller 10 gives an instruction to each of the compressors A0–D0, so as to decrease down the flow rate. In more detail, it instructs to rotates the vane of the each of the inlet guide vanes 50*a*, 50*b* . . . which the compressor main bodies 60*a*, 60*b* . . . comprise therein respectively. As a result, the flow rates of the compressors A0–D0 are reduced down, simultaneously.

Each of the inlet guide vanes 50*a*, 50*b* . . . is rotated at a quick speed up to reaching to in the vicinity of the surge limit of each of the compressor main bodies 60*a*, 60*b* . . . , which are memorized in the memory means 11 provided in the controller 10. This is called by "αmode". Coming to close the surge limit point, the rotation speed of each of the inlet guide vanes 50*a*, 50*b* . . . is decelerated down to about one-fifth (⅕) of the rotation speed as it was. This is called by "βmode".

During the inlet guide vanes 50*a*, 50*b* . . . continuing to rotate in the "βmode", the pressure fluctuation is detected by the pressure sensor 70*a* equipped within the compressor A0 and thereby the pressure fluctuation is inputted into the controller. Since no pressure fluctuation was detected by the other pressure sensors 70*b* . . . up to this time point, it is possible to know that the compressor main body 60*a* of the compressor A0, rushes into the surge at first. Then, while opening the blow-off valve 80*a*, which is provided at the discharge side of the compressor main body 60*a*, so as to release the pressure at the discharge side of the compressor main body, the inlet guide vane 50*a* is fully opened, so as to reduce the power of the compressor main body 60*a*. This is called by an unload operating condition ("γmode"). In this instance, an angle of the inlet guide vane 50*a*, being memorized in the memory means 11, is re-written by an angle of the inlet guide vane 50*a* at the time when the compressor rushed into the surge.

Since the compressor A0 is under the un-load operating condition, the flow rate of the compressor system goes down, abruptly. Then, the flow rates of the remaining three (3) compressors B0–C0 are adjusted, so that the inlet guide vanes 70*b* . . . are opened. However, in the case where the flow rate of the compressor system is not yet lowered down to a target flow rate in spite of this abrupt fall-down in the flow rates, the inlet guide vanes are rotated in the direction of closing, quickly, in the "αmode", so that the three (3) sets of the compressors B0–C0 reduce the flow rates thereof, continuously. However, in the present embodiment, since only one (1) set of the compressor A0 is under the un-load operating condition, the discharge flow rate falling down abruptly is turned back to the flow rate at the time before. However, if the requested flow rate is far less than the flow rate at the time just before rushing into the surge, since it is useless to turn the flow rate back to that before, it is practical to turns it up to the flow rate on the way thereof, as is indicated by a dotted line in the figure, at the upper most graph shown in FIG. 2.

In the present embodiment, as the four (4) sets of the compressor main bodies 60*a*, 60*b* . . . are used ones having the same capacity and the same model number. However, even being same, the individual compressor, separating from the products of the mass production, differs delicately from one another, actually, in particular, in the surge rushing point. The reason of this lies in, for example: unevenness or non-uniformity in the blade angles in the compressors; difficulty in accurately aligning the inlet guide vanes at an initial setting angle; and/or reduction in thickness or adhesion of dust due to changes, etc., upon an actual result of employments of the respective compressors in the past. As a result of the above, the surge rushing point differs for each of the compressors, individually. Furthermore, since the differential pressure gauge adopted in the present embodiment has such a responding speed that it can fully detect the difference in the surge rushing point for each the compressor, therefore no such a drawback is caused therein, that a large number of compressors are operated in the surge regions thereof, though being afraid of in the conventional art.

When the flow rate recovers up to a predetermined flow rate, which is equal to that before the compressor A0 rushes into the surge, or less than that, the inlet guide vanes 50*b* . . . of the compressors B0–D0 are rotated, quickly under the "αmode", again. In the similar manner when driving four (4) sets of the compressors, the inlet guide vanes 50*b* . . . are continuously rotated under the "αmode" until when coming close to the surge limit data memorized in the memory means 11 in advance, and then they are rotated slowly, under the "βmode", when approaching to the limit data.

When the differential pressure gauge B1 of the compressor B0 detects that the compressor B0 rushes into the surge, the controller 10 brings the inlet guide vane 50*b* of that compressor B0 into fully closed, while instructing the blow-off valve 80*b* to be opened. With this, the compressor B0 is in the un-load operating condition of the "γmode". In this instance, angular data of the inlet guide vane 50*b*, being the surge limit data of the compressor B0 memorized in the memory means 11, is replaced by the angular data of the inlet guide vane 50*b* when the compressor rushes into the surge.

Because the compressor B0 is driven also in the un-load operating condition, the discharged flow rate of the compressor system reduces again, abruptly. Then, the flow rates of the remaining two (2) sets of the compressors C0 and D0 increase up. Thus, the inlet guide vanes are rotated quickly under the "αmode", so as to increase the discharge flow rate up to a predetermined flow rate, being equal to the flow rate just before the compressor B0 rushes into the surge or less than that. If the requested flow rate is far less than the flow rate just before the rushing into the surge, since the waste of the power is rather small when it is not recovered up to the flow rate before, as is indicated by the dotted line in the upper portion of the FIG. 2, therefore it is practical. When the discharge flow rate is recovered up to a predetermined amount or the flow rate before, the inlet guide vanes are rotated under the "αmode", and then they are shifted into the "βmode" when approaching to the surge limit.

When the differential pressure gauge of the compressor C0 detects the rushing into the surge during the operation of the compressor C0 under the "βmode", the controller 10 avoids the compressor C0 from rushing into the surge. Namely, it opens the inlet guide vane of the compressor C0 in the angle a little bit, quickly. This is called by "α' mode". When the compressor is driven under the unload operation from this condition, it is impossible to achieve the requested flow rate by the means of only one (1) set of the compressor D01, through the flow rate control operation by combining the unload operation and the rotating of the inlet guide vane thereof, in particular when the requested flow rate lies in a certain range. Then, two (2) sets of the compress or continue the operations thereof. And, for satisfying the requested flow rate upon the compressor system, the compressor C0 is operated to blow-off. Thus, the blow-off valve of the compressor C0 is opened intermittently upon the basis of the discharge pressure, which is detected by the pressure sensor 90, thereby blowing off the flow rate in excess. This is also called by the "δmode". The compressor D0 maintains the inlet guide vane angle at the time when the compressor C0 rushes into the surge. This is called by "εmode". However, it is also same to the cases of the compressors A0 and B0 that the surge limit data of the compressor C0 memorized in the memory means 11 is replaced by the inlet guide vane angle at the time when it rushes into the surge.

When a time ratio of flow-off to the flow-on from the blow-off valve provided in the compressor C0 has comes to be long, the compressor C0 is brought into the un-load operation (i.e., the "γmode") while the compressor D0 in the "δmode" Thus, the blow-off valve of the compressor D0 is opened intermittently, upon the basis of the discharge pressure detected by the pressure sensor 90. When the compressor C0 or D0 is in the blow-off operation, the flow sent from the each compressor to the receiver tank 85 comes to be in the value, as shown by a dotted line, in the second portion of the graphs from the bottom shown in FIG. 2. Accordingly, the flow rate being produced by the compressor system decreases down as the time passes, as was shown in the upper most portion of the graphs in the same figure.

The change in power consumption is shown by one-dotted chain lines ($P_T$, $P_{A0}$–$P_{D0}$) in FIG. 2, when the compressors A0–D0 are controlled in the manner as was mentioned above. The power P of the turbo-compressor can be expressed by the following:

$$P = {}^{\gamma QH}/_{\eta}$$

where the flow rate is Q; the head H; the specific gravity of gas γ; and an efficiency η. Assuming that the efficiency is at the highest when the flow rate is at 100% and is at the lowest when the flow rate is at the minimum, then a power consumption curve can be obtained, roughly, as is shown in FIG. 2. Also, though the compressors A0–C0 are operated under the unload condition, however the powers do not come down to zero (0) during the time when they are in the unload operation, but they consume the power by a certain amount. Further, the compressors C0 and D0 are operated in the blow-off condition, and they consume the power same to that consumed when performing no such the flow-off, in the blow-off operation.

Next, explanation will be given on the case where the gas consumption at the consumer is larger than the gas capacity generated by the compressor system at the present. In this case, the discharge pressure detected by the pressure sensor 90 is lower than a predetermined pressure. Then, when all the compressors are stopped, the compressor controller 10 selects one among the four (4) sets of the compressors A0–D0, which is shortest in the operation time thereof. If the compressor C0 is that of being shortest in the operation time, then the controller opens the inlet guide vanes of that compressor C0 while closing the flow-off vane, thereby bringing the compressor C0 back into the load operating condition.

If the pressure does not comes up to the necessary discharge pressure under this situation, the compressor controller 10 further selects one among the remaining three (3) sets of the compressors A0, B0 and C0, i.e., B0 of being shortest in the operation time. The controller opens the inlet guide vane 50*b* while closing the blow-off valve 80*b*, thereby bringing the compressor B0 into the load operating condition. The same or similar operation will be repeated. However, in the present embodiment, the compressor is determined to be brought back into the load operation, depending upon the operation time thereof, but it may be also possible to bring back the compressors into the load operation, in the sequential order of starting from the compressor rushing into surge earliest, at first. Further, the inlet guide vane and the flow-off valve are so controlled that the each compressor escapes from the surging point and a choke point, based on signals sent from the differential pressure gauges A1, B1 . . .

According to the present embodiment, the following advantages can be obtained comparing to the cases where the compressors are controlled individually. When closing the inlet guide vanes of the three (3) sets of the compressors, simultaneously, the controller controls those three (3) sets to rotate their guide vanes to close, simultaneously, until when they rush into the surge first. On a while, it is assumed that the controller brings one (1) set of the compressor into the unload operating condition until the discharge pressure comes to a desired one, while bringing the other two (2) sets into the load operating condition. The power consumption of this situation is shown in FIG. 3, being compared to the case when the three (3) sets are controlled at the same time.

In FIG. 3, the power for the one (1) set of the compressor is indicted by P100. The power to bring the one (1) set of the compressor into the unload operating condition is about 10–20% (15% in FIG. 3) of that when operating the one (1) set of the compressor at 100%. The power at the time when the one (1) set of the compressor is brought into the unload operating condition comes to be P15, i.e., 15% of P100. When controlling the flow rates of the compressors by rotating the inlet guide vanes of the three (3) sets into the closing direction, at the same time, the power is lost by about 7%.

When controlling the flow rate of the compressors with an assumption of no such the losses therein in FIG. 3, the power consumed changes from a point "Z" to a point "A". At the point where the flow rate of the compressors is 60%, the consumed power comes to be P180. By taking the operation loss assumed in the above into the consideration, the consumed power when controlling the flow rate of the compressors by controlling the inlet guide vanes of the three (3) sets at the same time is P193, i.e., P180 plus the loss of 7%.

The consumed power when controlling the two compressors individually is P195, i.e., the consumed power P180 of two (2) sets of the compressors plus the consumed power P15, which is consumed by the unload operation of one (1) set of the compressor. Thus, controlling three (3) sets of compressors by the inlet guide vanes thereof is smaller than controlling them individually, in the power consumption by about 1.0% thereof.

By the way, when the compressors are operated for a long time, there sometimes occurs a situation that it is possible to obtain only performances, different from the estimated at beginning, due to adhesion of dust on the surface of fluid path, and/or reduction in thickness of the vane of an impeller, etc. Also, if the gas sucked by the compressors is air, the suction condition is changed greatly depending upon the seasons. Thus, for the compressors, two (2) conditions, i.e., the external conditions and the internal conditions are changing; therefore they are not necessarily always under the standard conditions thereof. This manner is shown in FIGS. 4 and 5.

FIG. 4 shows examples of an expected performance curve of the each compressor under the standard condition (i.e., a curve indicative of the relationship of the head to the flow rate) and a performance curve of the compressor operating actually. There are shown examples H1 and H2 put together, wherein the former indicates an example, that the performance curve of the compressor when it operates actually is shifted from the performance curve H2 estimated under the standard condition, in the large flow rate side, while the latter, in the low flow rate side. While the flow rate of the compressor changes between a point "B" and a point "E" on the performance curve H2 that is estimated, the flow rate of the compressor changes from a point "A" to a point "D" on the performance curve H1 that is actually obtained. For this reason, if controlling by considering this compressor to have the performance curve H2, the choke occurs therein, easily. Also, if trying to reduce the flow rate, so as to decrease the discharge pressure, however the flow rate will not falls down, causing a drawback that the performances of the compressor cannot be obtained or withdrawn, fully.

In the similar manner, when the actual performance curve is as H3, the range of the flow rate of the compressor is shifted between the point "C" and the point "F". Accordingly, though the choke phenomenon will occurs scarcely when conducting the control for rising up the flow rate, however the compressor will rush into the surge earlier than the time being expected, when being controlled to reduce the flow rate thereof, thereby causing a drawback of generating an unstable phenomenon.

Figure 5:
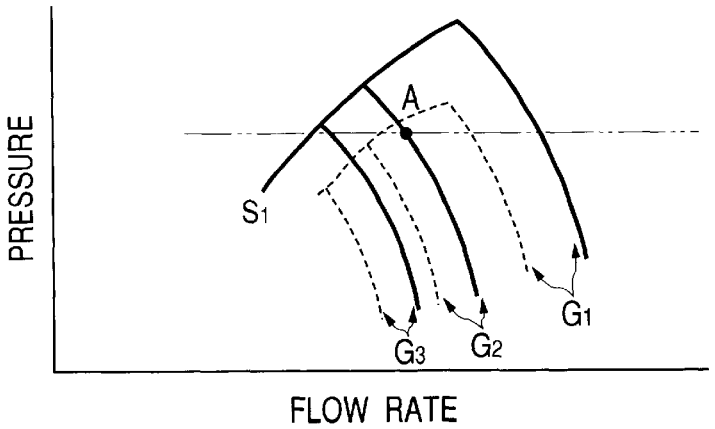
FIG. 5 is also a graph for explaining the difference in the performances in the compressor system depending upon changes of external conditions.

FIG. 5 shows a manner of changing in the operation range of the compressor, depending upon the changes on the suction conditions of the compressor. If the suction temperature is high, the operation range of the compressor comes to be narrow (see the solid line in FIG. 5), while low in the suction temperature being wide on the operation range thereof (see the broken line in FIG. 5). If trying to continue the operation of the compressor under the operating condition at the time when the suction temperature is low, may be occur that the compressor will surge and/or choke when the suction temperature of the compressor rises up, in particular when the suction temperature of the compressor rises up thereafter. If keeping the compressor to operate under the operating condition at the time when the suction temperature is high, it may be occur that the compressor continues to operate under the situation that it cannot fully show the performances thereof, thereby increasing up the consumed power greatly, in particular when the suction temperature comes down thereafter. Then, measuring the fluctuations in the discharge pressure of the compressor, thereby knowing the operating condition on each of the compressors, enables to operate the plural numbers of compressors under energy saving operation. However, G1 in the FIG. 5 indicates the situation where the inlet guide vanes are opened at the most, G2 the situation where the inlet guide vanes are middle in the opening degree thereof, and G3 the situation where the inlet guide vanes are at the least. Also, S1 indicates the surge limit.

According to the present embodiment, even in the case where the plural numbers of the compressors of the same capacity and the same type are prepared and are connected in parallel with one another, since the compressors are controlled, simultaneously, by paying an attention onto the fact that the surge limit differs from, due to unevenness in the products depending upon the individual compressor, etc., therefore, the compressor system can be operated with stableness, by means of a simple control method. And, it is also possible to suppress the power consumed therein. Though the explanation was given only on the cases where the each compressor has the same capacity in the above, however the present invention may be also applied into a case where the compressors differ from in the capacity thereof, in the similar manner. Further, it is needless to say that the number of the compressors should not be limited only to the four (4) sets.

According to the present invention, in the compressor system in which plural numbers of the compressors are connected in parallel with one another, the load for the each compressor is lowered when the load comes down, thereby bringing the compressor, which rushes into the surge at the earliest, into the unload operating condition, therefore, it is possible to achieve the partial load operation easily, by means of a simple control. Also, even when conditions changes, such as, the suction condition and/or the individual states or conditions of the each compressor, etc., it is possible to obtain an effective operation thereof.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A control method for plural numbers of compressors, comprising:

decreasing down flow rates of all the compressors which are driven under load operating condition, when a load of plural numbers of the compressors goes down;

bringing the compressor, which rushes into surge at the earliest, into an unload operating condition; and increasing up the load of the compressors other than that brought into the unload operating condition, thereby enabling an operation depending upon the load, wherein said plural numbers of the compressors are turbo compressors, and said method further comprises the following steps of:

obtaining surge limit of at least one of the compressors in advance; and memorizing the surge limit into memory means, wherein the flow rate is decreased down quickly until a point where the flow rate is larger than the surge limit memorized in said memory means by a predetermined amount, when decreasing down the flow rate of the compressor as the load comes down, and thereafter is changed more slowly than a period before, until a time of rushing into surge.

2. A control method for plural numbers of compressors, as defined in the claim 1, wherein the surge limit data memorized in said memory means is an opening angle of inlet guide vanes, and the surge limit data memorized in said memory means is renewed by the opening angle of the inlet guide vanes at a time of rushing into the surge.

3. A control method for plural numbers of compressors, as defined in the claim 1, wherein in a case of the compressor having the surge limit data obtained in advance among the plural numbers of the compressors, the data is memorized in said memory means, while in a case of the compressor having no surge limit data, the data of the compressor having the surge limit data therein is applied to in place thereof.

4. A control method for plural numbers of compressors, as defined in the claim 1, wherein the compressors are started in an order of rushing into the surges and brought into the un-load operating condition, when all the compressors are stopped and then they are started again.

5. A control method for plural numbers of compressors, as defined in the claim 1, wherein the compressors under the unload operating conditions are brought into the load operating conditions in an order of rushing into the surge earlier, when turning them back, if the compressors under the unload operating conditions are plural in number thereof while the load increases up.

6. A control method for plural numbers of compressors, as defined in the claim 1, wherein the flow rate is reduced down so as to rush into the surge, and it is turned back to that at the time just before rushing into the surge, after once rushing into the surge, while a blow-off valve is opened, when the compressor under load operating condition is one (1) and the load goes down, thereby enabling control depending upon the load.

7. A compressor system having plural numbers of compressors connected in parallel, comprising:

surge detection means provided at discharge side of each of the plural numbers of compressors; and a controller means for controlling each of said plural numbers of compressors, so that a load for each of all the compressors is reduced down when a load of said compressor system goes down and the compressor rushing into surge at first is brought into an unload operating condition, while increasing up the loads of the other compressors, wherein each of said plural numbers of compressors is a turbo compressor having an inlet guide vanes at a suction side thereof, and said controller means gives an instruction of rotation angle to the inlet guide vanes depending upon change on the load of the each compressor.

8. A compressor system, as defined in the claim 7, further comprising a discharge-pressure detection means of the compressor system, provided in a downstream side from a junction position of said plural numbers of compressors connected in parallel, wherein said controller means gives an instruction of rotation angle to each of the inlet guide vanes, so that the discharge-pressure comes to be a predetermined pressure.

9. A compressor system, as defined in the claim 7, wherein said controller means has memory means for memorizing surge limit therein.

* * * * *